US010028042B1

(12) United States Patent
Liao et al.

(10) Patent No.: US 10,028,042 B1
(45) Date of Patent: Jul. 17, 2018

(54) SPEAKER AND SPEAKER BOX

(71) Applicant: AAC Technologies Pte. Ltd., Singapore (SG)

(72) Inventors: Huanbin Liao, Shenzhen (CN); Xin Jin, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/652,617

(22) Filed: Jul. 18, 2017

(30) Foreign Application Priority Data

Mar. 1, 2017 (CN) ..... 2017 2 0194757

(51) Int. Cl.

| | |
|---|---|
| ***H04R 1/02*** | (2006.01) |
| ***H04R 1/28*** | (2006.01) |
| ***H04R 9/02*** | (2006.01) |
| ***H04R 9/06*** | (2006.01) |
| ***H04R 7/18*** | (2006.01) |
| ***H04R 7/12*** | (2006.01) |

(52) U.S. Cl.
CPC ..... *H04R 1/023* (2013.01); *H04R 1/025* (2013.01); *H04R 1/288* (2013.01); *H04R 7/12* (2013.01); *H04R 7/18* (2013.01); *H04R 9/025* (2013.01); *H04R 9/06* (2013.01)

(58) Field of Classification Search
CPC ..... H04R 1/023; H04R 1/025; H04R 1/288; H04R 7/12; H04R 7/17; H04R 9/025; H04R 9/06
USPC ..... 381/124, 332
See application file for complete search history.

(56) References Cited

U.S. PATENT DOCUMENTS

| | | | | |
|---|---|---|---|---|
| 8,670,586 | B1 * | 3/2014 | Boyle | H04R 1/1008 381/189 |
| 9,363,589 | B2 * | 6/2016 | Lippert | H04R 1/023 |
| 9,674,603 | B1 * | 6/2017 | Yeh | H04R 1/24 |
| 2013/0156237 | A1 * | 6/2013 | Kim | H04R 9/06 381/191 |
| 2013/0170109 | A1 * | 7/2013 | Cohen | H04M 1/03 361/679.01 |
| 2015/0194648 | A1 * | 7/2015 | Fathollahi | H01M 2/1061 429/98 |
| 2016/0037243 | A1 * | 2/2016 | Lippert | H04R 1/023 381/166 |
| 2017/0164096 | A1 * | 6/2017 | Herold | H04R 1/2853 |

* cited by examiner

*Primary Examiner* — William A Jerez Lora
(74) *Attorney, Agent, or Firm* — Na Xu; IPro, PLLC

(57) ABSTRACT

The present disclosure relates to a speaker and a speaker box including the speaker. The speaker includes a frame including a side wall and defining a plurality of leaking holes through the side wall, a lower clamping plate covering the frame and sealedly connected with the frame, a plurality of first dust proof meshes and a plurality of second dust proof meshes; the first dust proof meshes and the second dust proof meshes correspond to the leaking holes; the side wall includes an external surface and an internal surface, the plurality of first dust proof meshes is on the external surface and completely covers the plurality of leaking holes, and the plurality of second-dust meshes is on the internal surface and completely covers the plurality of leaking holes. Under such structure, the speaker can work well together with the sound absorbing powder to form a virtual acoustic cavity.

9 Claims, 4 Drawing Sheets

SPEAKER AND SPEAKER BOX

TECHNICAL FIELD

The present disclosure relates to the technical filed of speaker devices and, specifically, relates to a speaker and a speaker box including the speaker.

BACKGROUND

In the relevant art, a speaker includes a frame and a lower clamping plate. The lower clamping plate covers the frame. The lower clamping plate includes four corners and a plurality of leaking holes, and the plurality of leaking holes is distributed at the four corners. The plurality of leaking holes is formed by fitting with the structure of the frame and the lower clamping plate. Articles outside the speaker can enter into the interior of the speaker through the plurality of leaking holes, which may influence normal working of the speaker. Therefore, the speaker cannot directly cooperate with a sound absorbing powder filled in the speaker box to form a virtual acoustic cavity, and the speaker box should be particularly designed to prevent the sound absorbing powder from entering into the speaker.

Accordingly, it is necessary to provide a new speaker to solve the above technical problem.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present disclosure is further described in detail as follows with reference to the accompanying drawings and exemplary embodiments.

Figure 1:
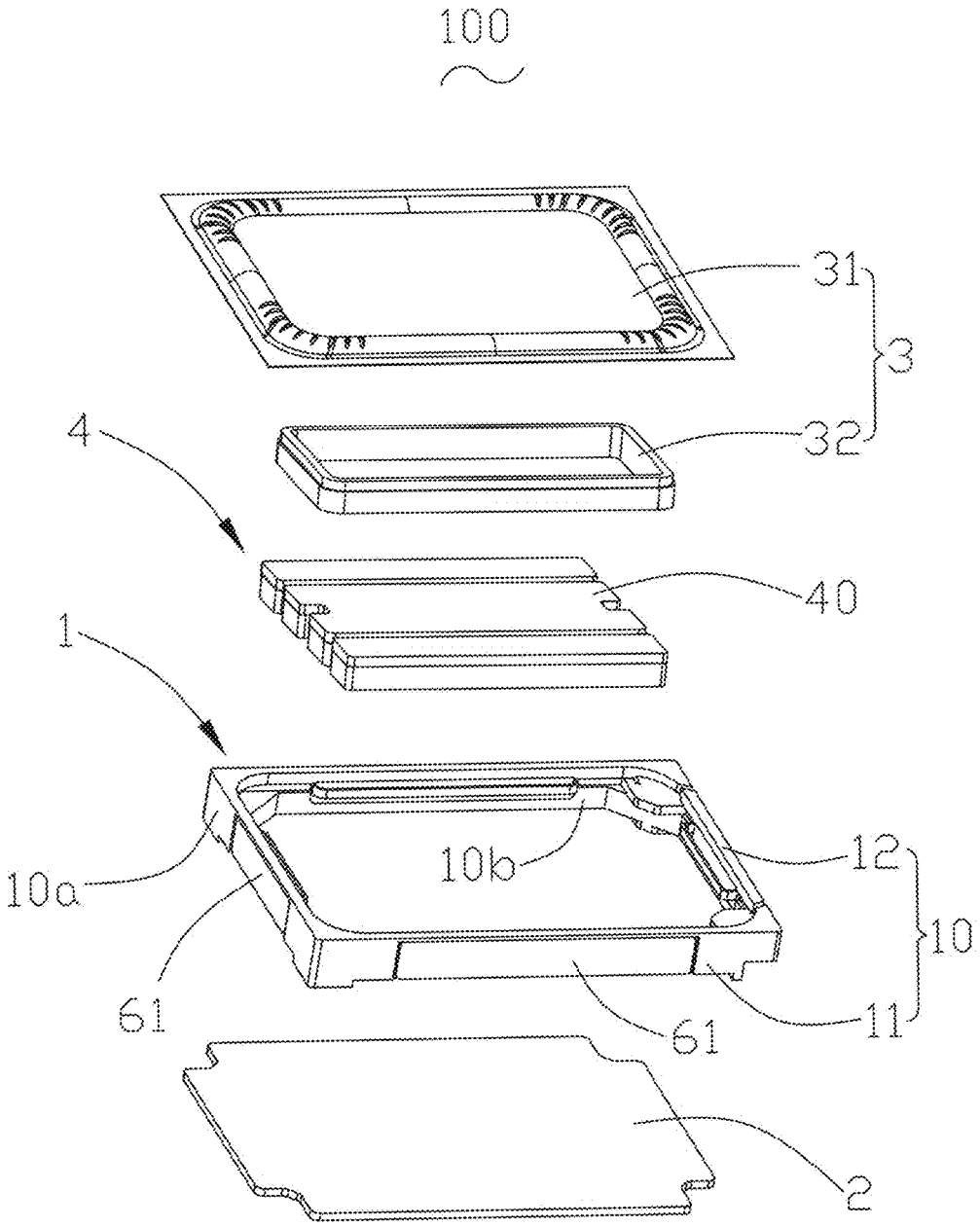
FIG. 1 is an exploded structural diagram of a speaker in accordance with an exemplary embodiment of the present disclosure.
Figure 2:
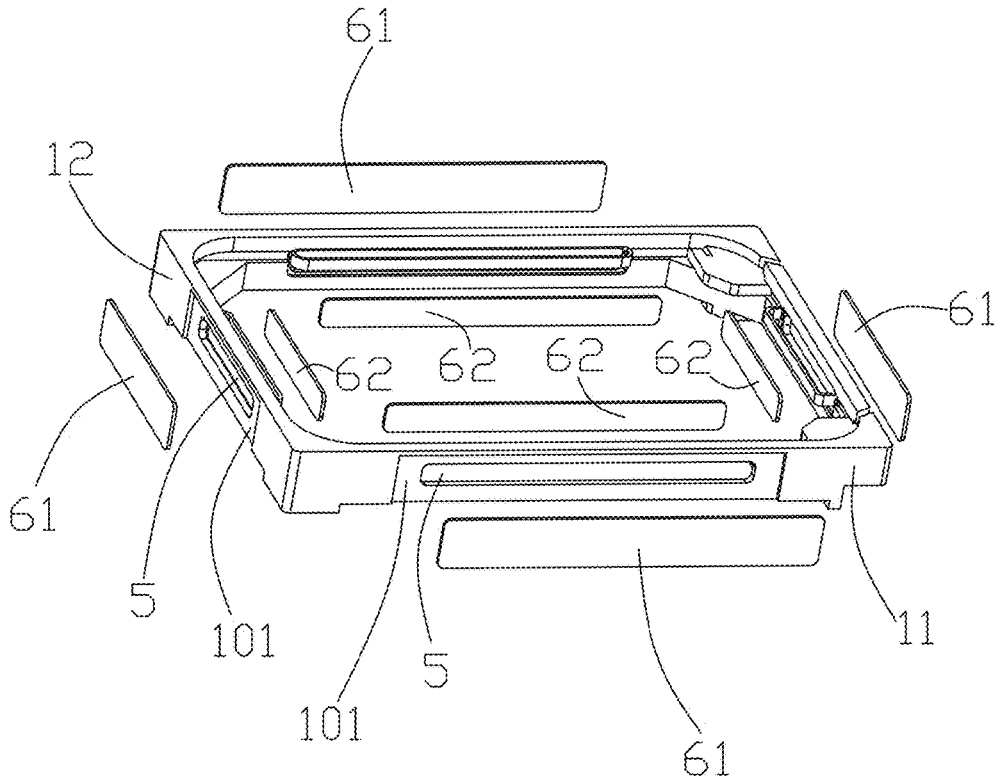
FIG. 2 is a structural schematic diagram of a frame of a speaker in accordance with an exemplary embodiment of the present disclosure.
Figure 3:
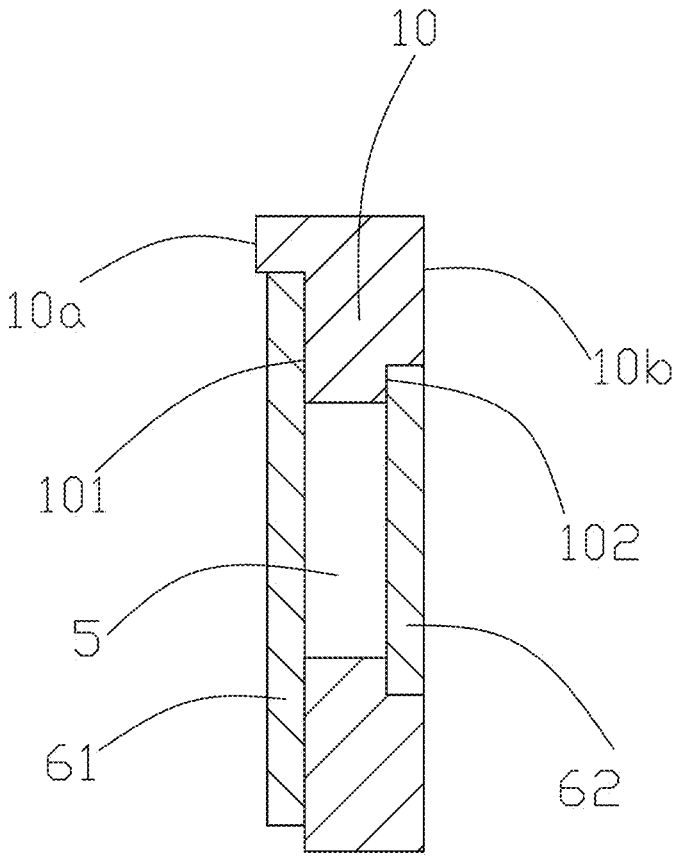
FIG. 3 is a structural schematic diagram of a leaking hole of a speaker in accordance with an exemplary embodiment of the present disclosure.

As shown in FIGS. 1-3, a speaker 100 is provided by the present disclosure. The speaker 100 includes a frame 1, a lower clamping plate 2, a vibration unit 3 and a magnetic unit 4. The lower clamping plate 2 covers the frame 1, and the vibration unit 3 and the magnetic unit 4 are fixed on the frame 1. The lower clamping plate 2 is sealed and connected with the frame 1. In an exemplary embodiment, sealing is formed between the lower clamping plate 2 and the frame 1 by means of a sealant.

The vibration unit 3 includes a diaphragm 31 and a voice coil 32. The diaphragm 31 is fixed at the frame 1, and the voice coil 32 is configured to drive the diaphragm 31 to vibrate.

Under the interaction of a magnetic field generated by the magnetic unit 4 and the vibration unit 3, the magnetic unit 4 drives the vibration unit 3 to vibrate and sound.

The magnetic unit 4 includes a bottom plate and a magnet 40, and the magnet 40 is placed on the bottom plate. It should be noted that, the lower clamping plate 2 could be a portion of the magnetic unit 4, e.g., the lower clamping plate 2 is the bottom plate of the magnetic unit 4. The lower clamping plate 2 can be a magnetic conducting plate with a flat plate shape or a bottom wall of a yoke with a bowl shape.

The frame 1 includes a side wall 10 and a leaking hole 5 penetrating through the side wall 10. The side wall 10 includes a top end and a bottom end, the lower clamping plate 2 covers the bottom end of the side wall 10, and the diaphragm 31 is fixed on the top end of the side wall 10. The frame 1 may include a plurality of leaking holes 5, and the plurality of leaking holes 5 is symmetrically distributed in the side wall 10. The speaker 100 further includes a first dust proof mesh 61 and a second dust proof mesh 62 at each leaking hole 5. The side wall 10 includes an external surface 10*a* and an internal surface 10*b*. The first dust proof mesh 61 is arranged on the external surface 10*a* and completely covers the leaking hole 5, and the second dust proof mesh 62 is arranged on the internal surface 10*a* and completely covers the leaking hole 5. Preferably, the external surface 10*a* of the side wall 10 defines a first accommodating slot 101 and the internal surface 10*b* of the side wall 10 defines a second accommodating slot 102. The first accommodating slot 101 is configured to accommodate the first dust proof mesh 61, and the second accommodating slot 102 is configured to accommodate the second dust proof mesh, so as to guarantee flatness of the external surface 10*a* and the internal surface 10*b* of the side wall 10. Two layers of dust proof meshes can effectively prevent an external article from entering into the speaker 100. The first dust proof mesh 61 directly contacts the external article. Accordingly, the first dust proof mesh 61 may have a larger area than the second dust proof mesh 62, so that the first dust proof mesh 61 and the side wall 10 can have a larger contact area, so as to guarantee that the first dust proof mesh 61 and the side wall 10 can have better bonding strength.

In an exemplary embodiment, the side wall 10 includes two long side walls 11 and two short side walls 12, the two long side walls 11 face toward each other, and the two short side walls 12 face toward each other. Alternatively, the plurality of leaking holes 5 is defined in the two long side walls 11, or the plurality of leaking holes 5 is defined in the two short side walls 12, or the plurality of leaking holes 5 is defined in both the two long side walls 11 and the two short side walls 12. Preferably, the frame 1 defines four leaking holes 5, and the four leaking holes 5 are symmetrically distributed in the two long side walls 11 and the two short side walls 12.

The leaking effect of the speaker 100 can be conveniently adjusted according to a size of an open area of the leaking hole 5 in the side wall 10. In order to maximize the leaking effect, since the two long side walls 11 are larger in size than the two short side walls 12, the leaking hole 5 in any of the two long side walls 11 is configured to have a greater open area than the leaking hole 5 in any of the two short side walls 12. Thus, the speaker 100 can have maximized leaking effect. The leaking hole 5 is preferably shaped in a long strip fitting with a shape of the long side wall 11 and a shape of the short side wall 12.

Figure 4:
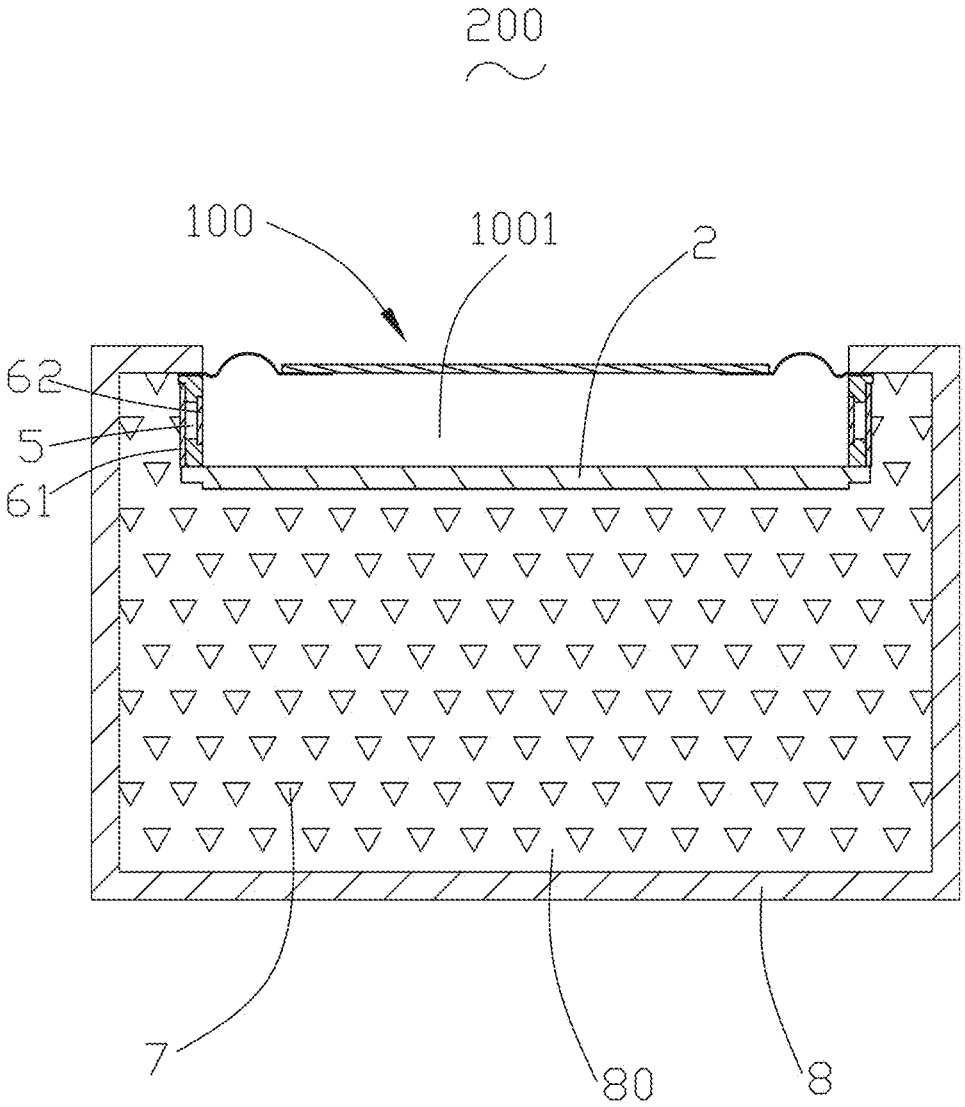
FIG. 4 is a structural schematic diagram of a speaker box in accordance with an exemplary embodiment of the present disclosure.

As shown in FIG. 4, the present disclosure provides a speaker box 200. The speaker box 200 includes the speaker 100, a sound absorbing powder 7 and a housing 9. The sound absorbing powder 7 is filled outside the speaker 100. The speaker 100 and the sound absorbing powder 7 are packaged in the housing 8. In the speaker box 200, the speaker 100 and the housing 8 enclose to define an internal cavity 80, and the sound absorbing powder 7 is filled in the internal cavity 80. The sound absorbing powder 7 cannot enter into an interior 1001 of the speaker 100, and it is not necessary to specially design the speaker box 200 to prevent the sound absorbing powder 7 from entering into the interior 1001 of the speaker 100. Therefore, the speaker 100 can better cooperate with the sound absorbing powder 7 filled in the speaker box 200 to form a virtual acoustic cavity.

The above are merely exemplary embodiments of the present disclosure. It should be noted that, those skilled in the art can make improvements to the present disclosure without departing from the invention concept of the present disclosure, and all these improvements shall fall into the protection scope of the present disclosure.

What is claimed is:

1. A speaker box, comprising:

a speaker;

a sound absorbing powder filled outside the speaker, and a housing configured to package the speaker and the sound absorbing powder;

wherein the speaker comprises:

a frame, the frame comprising a side wall;

a lower clamping plate, the lower clamping plate covering the frame and being sealed and connected with the frame;

a plurality of first dust proof meshes; and a plurality of second dust proof meshes;

the side wall defines a plurality of leaking hole penetrating through the side wall; the plurality of first dust proof meshes and the plurality of second dust proof meshes corresponds to the plurality of leaking holes;

the side wall comprises an external surface and an internal surface, the plurality of first dust proof meshes is arranged on the external surface and completely covers the plurality of leaking holes, and the plurality of second dust proof meshes is arranged on the internal surface and completely covers the plurality of leaking holes.

2. The speaker as described in claim 1, wherein the side wall comprises two long side walls and two short side walls, the two long side walls face toward each other, the two short side walls face toward each other, and the plurality of leaking holes is defined in the two long side walls and/or the two short side walls.

3. The speaker as described in claim 1, wherein the plurality of leaking holes is symmetrically distributed in the side wall.

4. The speaker as described in claim 2, wherein an open area of each of the plurality of leaking holes in each of the two long side walls is greater than an open area of each of the plurality of leaking holes in each of the two short side walls.

5. The speaker as described in claim 1, wherein an area of each of the plurality of first dust proof meshes is greater than an area of each of the plurality of second dust proof meshes.

6. The speaker as described in claim 1, wherein the side wall defines a plurality of first accommodating slots at the external surface, and the plurality of first accommodating slots is configured to accommodate the plurality of first dust proof meshes, respectively.

7. The speaker as described in claim 1, wherein the side wall defines a plurality of second accommodating slots at the internal surface, and the plurality of second accommodating slots is configured to accommodate the plurality of second dust proof meshes, respectively.

8. The speaker as described in claim 1, further comprising a magnetic unit, wherein the lower clamping plate is a bottom plate of the magnetic unit.

9. The speaker as described in claim 1, wherein a sealant is disposed between the lower clamping plate and the frame to achieve sealing.

* * * * *